US008281647B2

(12) United States Patent
Boutet et al.

(10) Patent No.: US 8,281,647 B2
(45) Date of Patent: Oct. 9, 2012

(54) DEVICE FOR MEASURING PHYSICAL AND/OR CHEMICAL PARAMETERS OF WATER CIRCULATING IN A TREATMENT CIRCUIT OF A LEISURE POOL

(76) Inventors: Jean-Marc Boutet, Le Pecq (FR); Omar Saaid, Maisons Laffitte (FR)

( * ) Notice: Subject to any disclaimer, the term of this patent is extended or adjusted under 35 U.S.C. 154(b) by 549 days.

(21) Appl. No.: 12/457,856

(22) Filed: Jun. 23, 2009

(65) Prior Publication Data

US 2010/0000300 A1 Jan. 7, 2010

(30) Foreign Application Priority Data

Jun. 23, 2008 (FR) ..... 08 54120

(51) Int. Cl.
*G01N 33/00* (2006.01)

(52) U.S. Cl. ..... 73/61.41

(58) Field of Classification Search ..... 73/61.41, 73/61.43

See application file for complete search history.

(56) References Cited

U.S. PATENT DOCUMENTS 5,422,014 A * 6/1995 Allen et al. ..... 210/743
2003/0034898 A1* 2/2003 Shamoon et al. ..... 340/825.72
2003/0221250 A1 12/2003 Gibson
2003/0227394 A1 12/2003 Rothgeb et al. ..... 340/870.01
2005/0067049 A1* 3/2005 Fima ..... 141/192

FOREIGN PATENT DOCUMENTS

| | | |
|---|---|---|
| GB | 2210459 | 6/1989 |
| WO | 03046549 | 6/2003 |
| WO | 2007002530 | 1/2007 |
| WO | 2007019577 | 2/2007 |

OTHER PUBLICATIONS

Search Report from priority application FR0854120.

* cited by examiner

*Primary Examiner* — Peter Macchiarolo
*Assistant Examiner* — Tamiko Bellamy

(57) ABSTRACT

A device for measuring physical and/or chemical parameters of water circulating in a treatment circuit of a leisure pool comprises: a main body (12) through which a measurement channel (13) passes; a connector (14*a*, 14*b*) for connecting the measurement channel (13) to the treatment circuit (8); at least two measurement sensors (18*a*, 18*b*) fitted to the main body in order to be in contact with the inside of the measurement channel (13); and an acquisition unit (20) connected to the measurement sensors and comprising a self-contained electric power source (32) and wireless communication means (45) for communicating with a central unit (5).

10 Claims, 2 Drawing Sheets

DEVICE FOR MEASURING PHYSICAL AND/OR CHEMICAL PARAMETERS OF WATER CIRCULATING IN A TREATMENT CIRCUIT OF A LEISURE POOL

The present invention relates to the technical field of monitoring the water quality of a leisure pool by regularly measuring physical and/or chemical parameters characteristic of this quality.

In order to ensure perfect comfort during use, and also good hygiene of a leisure pool, such as a personal or private swimming pool, it is necessary to maintain chemical parameters, such as the pH, the dissolved chlorine content or the dissolved oxygen content, and also the temperature, within acceptable value ranges. For this purpose, the person responsible for the maintenance of the swimming pool, usually its owner, must, at regular intervals, carry out measurements by withdrawing samples in order to check that the concentrations conform with optimal ranges of values known for guaranteeing the salubrity of the water. Such sampling measurements generally take a lot of time and are tedious. Automatic systems of measurement and of adding chemicals have therefore been proposed that make it possible to adjust the corresponding parameters.

Thus, international application WO 2007/02530 proposed an autonomous floating detector, used in a swimming pool management plant, which makes it possible to automatically control the physicochemical properties of the water, such as the temperature, the pH and the oxygen content. The autonomous floating detector comprises a certain number of sensors that make it possible to measure these parameters and to compare them to thresholds that are considered to be desirable. In the event of crossing these thresholds, the detector transmits this information to a remote system that starts an oxygenation and filtration pump, and also dispenses cleaning products suitable for bringing the chemical parameter or parameters within acceptable value ranges.

Such a floating device effectively enables physical and chemical parameters of the water of the swimming pool to be measured, but has, however, certain drawbacks. Firstly, the floating device obstructs the inside of the pool and disrupts the use thereof. Furthermore, in the context of a family swimming pool in particular, the floating measurement device is capable of being accidentally damaged by users playing in the swimming pool. Lastly, the properties measured by the floating device only relate to the surface water of the swimming pool. It has turned out, with use, that this information is not representative of the physicochemical state of all of the water of the swimming pool.

In order to overcome these drawbacks, systems are also known that make it possible to position sensors in the water filtration pipes of the swimming pool. Such systems then allow an individual placement of each sensor associated with a particular control, such as for example the pH, the chlorine content, the oxygenation level or else the temperature. The individual devices for placement of the sensors are then positioned in the vicinity of each associated control device and it is therefore necessary to carry out as many installation procedures as there are sensors. However, each sensor installation gives rise to a relatively long installation time, of the order of about ten minutes when this involves an individual piercing of a pipe, and creates a risk of leaks in the water treatment circuit of the swimming pool.

Thus, the need has emerged for a device that makes it possible to reduce the set-up time of the sensors while also reducing the risks of leaks in the water circuit.

In order to achieve this objective, the invention relates to a device for measuring physical and/or chemical parameters of water circulating in a treatment circuit of a leisure pool, which comprises:

- a main body through which a measurement channel passes;
- means for connecting the measurement channel to the treatment circuit;
- at least two measurement sensors fitted to the main body in order to be in contact with the inside of the measurement channel;
- an acquisition unit connected to the measurement sensors and comprising a self-contained electric power source and wireless communication means for communicating with a central unit.

The use of such a device makes it possible, on the one hand, to reduce the intervention time for the installation of the sensors insofar as it suffices to simply insert the device according the invention in place of a section of pipe, the main body of the device being shared by at least two sensors. Furthermore, the leaktightness of the installation and holding of the sensors is checked in the factory, so that the risk of leaks at the sensors is canceled contrary to what happens during the use of individual rings for holding the sensors. Furthermore, the cutting of a section of piping is a much simpler operation than the piercing thereof. Another advantage linked to the solution is the independence of the measurement device with respect to the quality of the existing piping: indeed, the main body may be made from a material that is hard-wearing over time, enabling the quality thereof to be retained, at least at the measurement device. Lastly, the integration of the acquisition unit having wireless communication also facilitates the installation insofar as it avoids having to run electric wiring between the measurement device and the central unit that uses the results of the measurements. The use of wireless, for example radio or Hertzian, communication and the self-contained power supply contributes, in addition, to promoting the electrical insulation of the sensors relative to the water of the leisure pool by avoiding any risk of an electrical coupling which would have been able to result, for example, from the use of an electrical connection line between the acquisition unit and a control machine which would furthermore be grounded. Thus, whatever the configuration of the swimming pool, no leakage current can flow from the measurement probes toward another element that is grounded or connected to any power supply. No particular precaution must then be taken during the installation of the device according to the invention. This perfect electrical insulation between the sensors and the water of the leisure pool then guarantees the quality of the measurements, especially as regards the chemical measurements, such as the measurements of pH, oxygenation and dissolved chlorine content. In this respect, it should be pointed out that the main body of the measurement device will then preferably be made from an electrically insulating material, such as for example a plastic such as polypropylene, polyethylene or else PVC.

The measurement device according to the invention therefore forms a complete ready-to-use assembly that integrates the installation functions of leaktight positioning and immobilization of the sensors, and also the acquisition and power supply functions of the latter. The acquisition unit then collects all the measurements from the sensors in order to subsequently convey them to one or more machines that control the members capable of affecting, via their operation, the values of the physical or chemical parameters measured by the sensors. The measurements carried out in this way are, on the other hand, made for certain in one and the same place, without a different interference agent on each. The fact of combining several measurements in one and the same place is all the more important since the various types of measurement are interdependent for the monitoring of the swimming pool.

According to one feature of the invention, the acquisition unit comprises means for processing the measurements made by the sensors and the wireless communication means are adapted to at least transmit the measurements made by the sensors and/or the result of the processing of these measurements by the processing means.

According to another feature of the invention, the device comprises fastening means for a casing for receiving the acquisition unit. The fastening means may then optionally be associated with a removable casing for receiving an acquisition unit. Of course, the receiving casing may also be an integral part of the device and may not be removable.

According to one feature of this embodiment of the invention, the self-contained electric power source of the acquisition unit comprises at least one electric accumulator such as a battery or a rechargeable cell. Of course, the self-contained electric power source may also comprise one or more non-rechargeable cells also known as primary cells.

According to another feature of the invention that aims to reduce the level of energy consumption of the acquisition unit and therefore to increase the service life of the self-contained power source, the acquisition unit is adapted in order to provide an intermittent power supply for the sensors and the communication means.

In the same sense, the acquisition unit will be able for example to be adapted in order to periodically acquire the measurements from each sensor according to a period having a duration between 3 min and 10 min.

According to another feature of the invention, the device comprises:

- at least one sensor for a chemical parameter of the water chosen from: the pH, the dissolved chlorine content and the dissolved oxygen content;
- a measurement chain dedicated to the chemical sensor; and
- a dedicated power supply for the dedicated measurement chain comprising a controller-inverter.

The use of a dedicated measurement chain and also of a power supply dedicated to the measurement chain makes it possible to ensure the quality of the chemical measurements that are generally carried out by a sensor that is particularly sensitive to its power supply conditions and that works with very low current values.

According to another feature that aims to ensure an excellent quality of the measurements of the chemical sensor, the dedicated power supply comprises at least one capacitor charged by the controller-inverter and the acquisition unit is adapted in order, during the acquisition of a measurement from the chemical sensor, to cut the power supply of the controller-inverter of the dedicated measurement chain so that it is only powered by the capacitor. This feature avoids any risk of disrupting the measurement by interference generated by the controller-inverter.

According to yet another feature of the invention, the acquisition unit comprises means for connecting an external measurement sensor. This feature is particularly advantageous when it is necessary to measure a physical or chemical parameter for which the optimal measurement site is located at a distance from the main body of the device according to the invention. Such is for example the case for measuring the pressure in the water treatment circuit, which will preferably be carried out at a filter, thus making it possible to deliver information indicative of the degree of fouling of the latter.

According to one feature of the invention, the device comprises a temperature sensor, a pH sensor, and a sensor of the amount of chlorine or oxygen dissolved in the water, which are fitted to the main body, and a pressure sensor, which is located at a distance from the main body and is connected to the acquisition unit.

According to one feature of the invention, the device comprises means for fastening electric cables. The use of such cable-fastening means makes it possible to secure the immobilization of these cables in order to avoid any untimely traction of the latter which may lead to ruptures or to extraction of the sensors to which they are connected.

Of course, the various features, embodiments and embodiment variants of the invention may be combined with one another in various combinations, insofar as the features, embodiment variants and embodiments are not incompatible with or exclusive of one another.

Moreover, various other features of the invention will emerge from the description below, made with reference to the appended drawings that illustrate a non-limiting embodiment of the subject of the invention.

Figure 1:
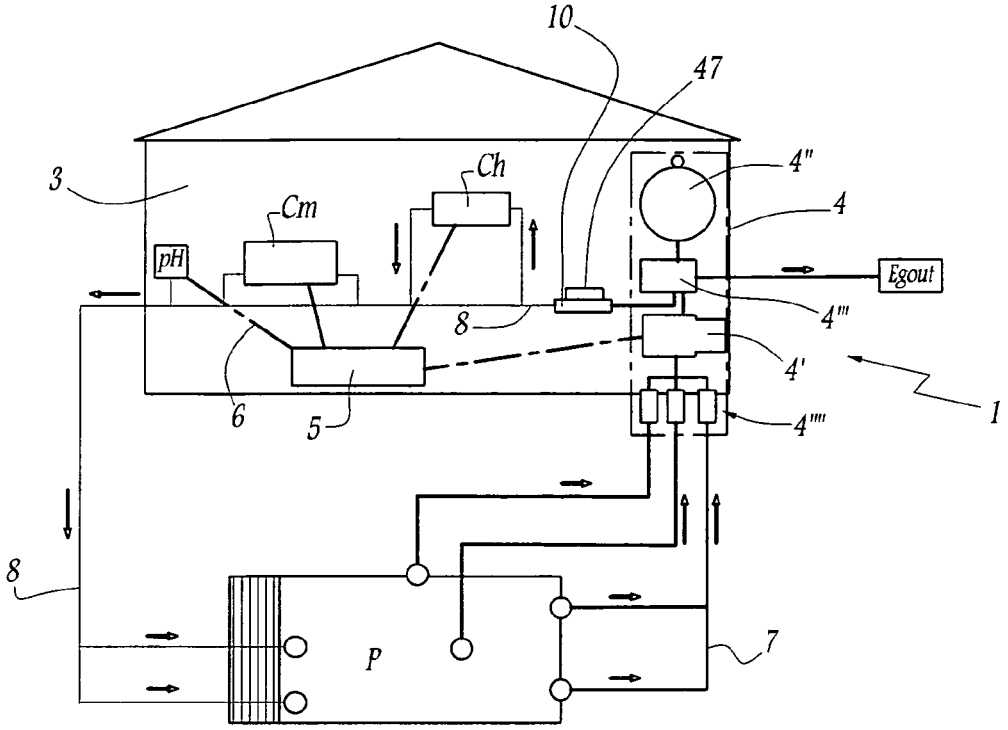
FIG. 1 is a schematic view of a leisure pool, such as a personal swimming pool, and of its associated water treatment plant.

As shown in FIG. 1, a leisure pool, such as a swimming pool P, is generally associated with a plant 1 for treating the water of the swimming pool. Such a plant 1 generally comprises a control room 3, placed inside which is a pumping unit 4 formed of a pump 4' and a filter 4". The pumping unit 4 may also comprise a multiway valve 4''' interposed between the pump 4' and the filter 4", and also a connection manifold 4'''' located upstream of the pump 4' on the opposite side from the filter 4" compared to the pump. The treatment plant 1 may also comprise various maintenance units that are also placed inside the control room, such as for example a unit for controlling the pH, a chemical treatment unit Cm for dispensing, for example, chlorine or oxygenating products, and a heating unit Ch. The pump 4' and the various maintenance units are then connected to a control unit or machine 5 which provides the power supply thereto and also the operation thereof according to at least hourly periods for example. The connection lines 6 between the unit 5 and the various units and/or pump are symbolized by a dot-and-dash line. It should be noted that the unit 5 generally comprises a user interface, not represented, that allows the automatic or manual starting of the maintenance units, the monitoring of the parameters, or more generally, the monitoring of the treatment plant. The treatment plant lastly comprises a set of pipes 7 and a water treatment circuit 8 that connects the pumping unit to various points of the swimming pool at which the water is either withdrawn or reinjected. The flow direction of the water is symbolized here by arrows located in the vicinity of the pipes 7 and 8.

In order to carry out the measurement of the physical and/or chemical parameters of the water to be treated so as to drive the operation of the treatment and control equipment, the invention proposes to incorporate into the pipes for circulating the water to be treated a device 10 for measuring physical and/or chemical parameters according to the invention. According to the example illustrated, the device 10 is located downstream of the pumping and filtration unit 4, which makes it possible, on the one hand, to avoid fouling of the device and, on the other hand, to carry out the measurements on water that results from a mixture of water originating from various sampling points of the swimming pool both at the surface and at depth. This mixture is thus perfectly representative of the general state of all the water of the swimming pool P.

Figure 2:
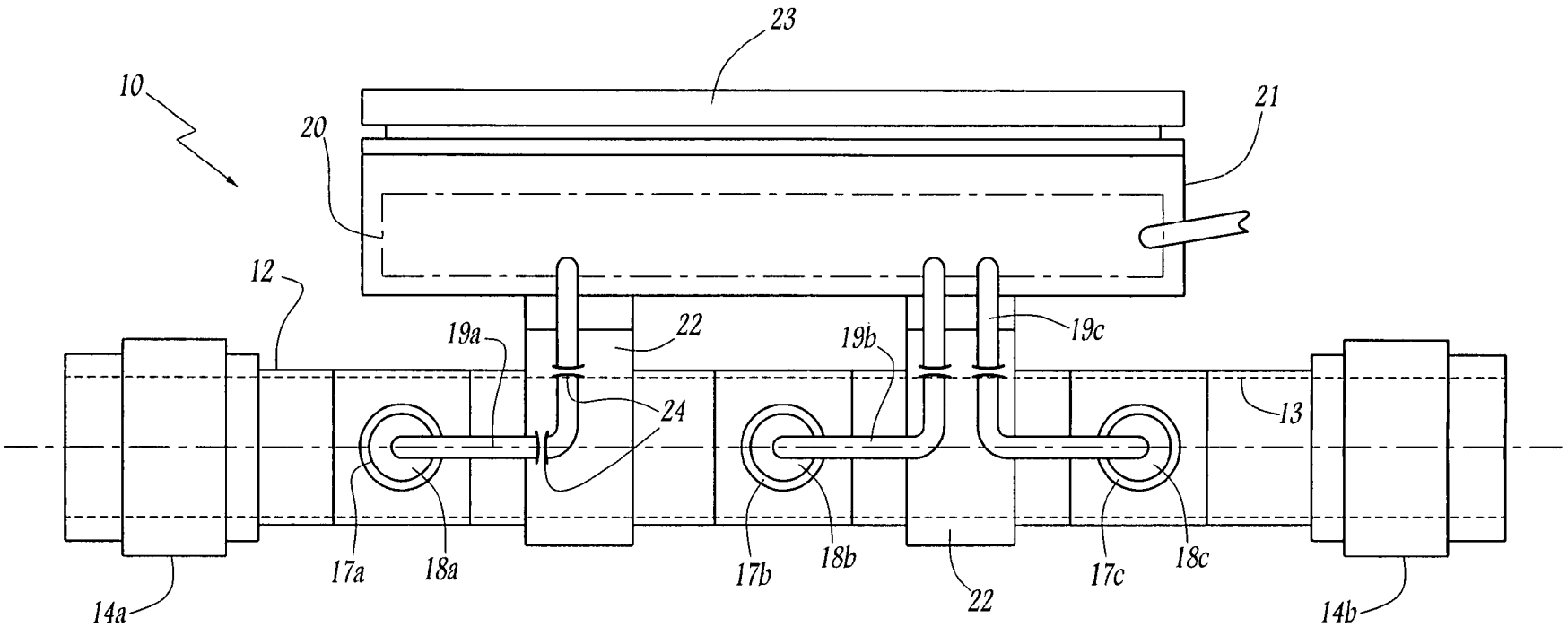
FIG. 2 is a schematic elevation of a device for measuring physical and/or chemical parameters according to the invention, used in the context of the treatment plant illustrated in FIG. 1.

As shown in FIG. 2, the device 10 comprises a main body 12 through which a measurement channel 13, illustrated by dotted lines, passes. The main body 12 is equipped at its two ends with means 14*a*, 14*b* for connecting to the water treatment circuit 8. The connecting means 14*a* and 14*b* may be produced in any appropriate manner, such as for example by rings to be clamped or else rings to be bonded depending on the embodiment of the water treatment circuit 8. Of course, each of the rings 14*a* and 14*b* may be of a different type. According to one main feature of the invention, the main body 12 also comprises means 17*a*, 17*b*, 17*c* for installing at least two, and according to the example illustrated, three sensors 18*a*, 18*b* and 18*c*. The means for holding and installing the sensors are for example each composed of a shaft that extends transversely to the axis Δ of the measurement channel 13 and that opens into the latter. Each shaft has a conformation complementary to that of the associated sensor, so that the engagement of the sensor in the shaft seals it. The use of sealing systems, such as for example O-rings, silicone-based adhesives and/or a PTFE tape, then makes it possible to obtain perfect leaktightness.

Each sensor 18*a*, 18*b*, 18*c* comprises an electric cable 19*a*, 19*b*, 19*c* which connects the corresponding sensor to an acquisition unit 20 located inside a casing 21 attached to the main body 12. According to the example illustrated, the casing 21 is fitted to fastening means formed by base plates 22 fitted to the body 12. This casing 21 may be leaktight. Of course, the base plates 22 could be integrated into the main body 12, similarly the leaktight casing 21 could also be integrated into the main body 12, so as to form, with the latter, a one-piece assembly, except perhaps as regards a cover 23 that seals the leaktight casing 21.

It should be noted that, according to the example illustrated, the main body 12 comprises fastening means 24, for electric cables 18*a*, 18*b*, 18*c*. The fastening means 24 may be produced in any appropriate manner, such as for example in the form of slots for receiving the cables or else clamps that cover said cables.

According to the example illustrated, the three sensors comprise a temperature sensor 18*a*, a sensor for measuring the pH 18*b* and a sensor for measuring the chlorine content 18*c*, it being understood that this sensor for measuring the chlorine content may be replaced by a sensor for measuring the dissolved oxygen content. The measurement device could also comprise both a sensor for measuring the amount of chlorine dissolved in the water and a sensor for measuring the dissolved oxygen content.

Figure 3:
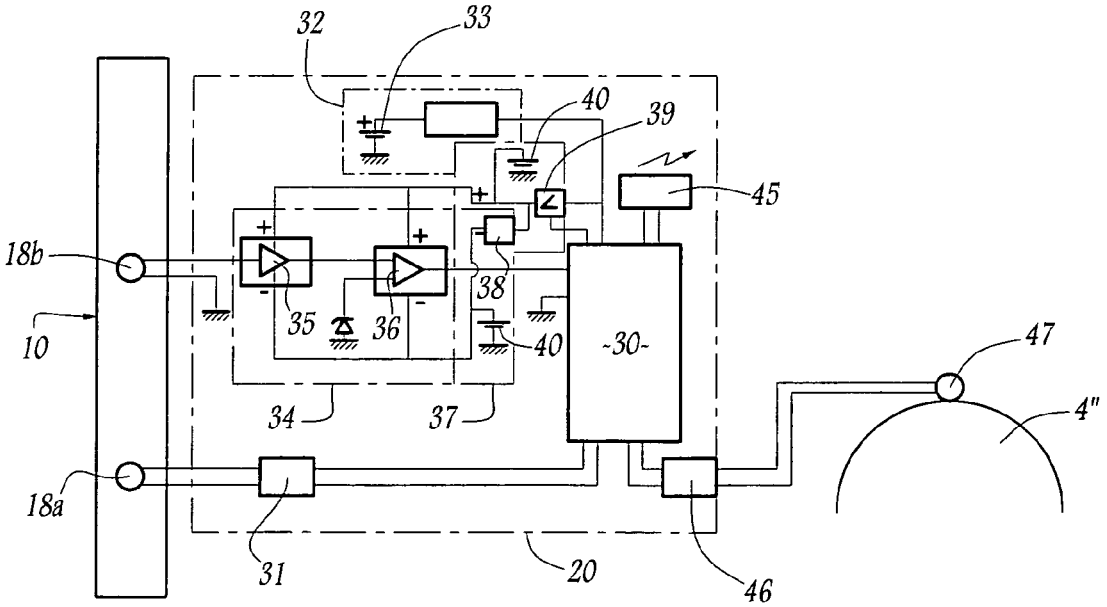
FIG. 3 is a schematic view of the acquisition unit incorporated into the device as illustrated in FIG. 2.

The acquisition unit 20 comprises, as can be seen in FIG. 3, means 30 for processing the measurements made by the sensors 18*a* to 18*c*. The processing means may, for example, be formed by a microcontroller that integrates, in particular, analog-to-digital conversion means. The sensors for measuring physical parameters, such as the temperature, are then connected to the processing means 30 via a protection system 31 that has a high impedance. The power supply of the acquisition unit 20 is provided by a self-contained electric power source 32 comprising at least one electric accumulator 33, such as a cell or a battery. The self-contained nature of the power source 32 then guarantees a perfect electrical insulation of the acquisition unit 20, and of the sensors which are connected thereto, with respect to the water that is the subject of the measurements. Unlike the sensors of physical measurements, the sensors of chemical measurements, such as the pH sensors 18*b* and the chlorine concentration sensor 18*c*, are each associated with a specific measurement chain 34 that comprises, according to the example illustrated, an amplifier-follower 35 associated with an amplifier-inverter 36 so as to perfectly amplify very low values of current flowing in the sensors. Each measurement chain 34 is then associated with a dedicated power supply 37 comprising a controller-inverter 38, which makes it possible to supply each of the amplifiers with symmetrical positive and negative voltages from the continuous voltage supplied by the source 32. According to one advantageous feature of the invention, insofar as the controller-inverter 38 is a source of electrical interference of the measurements, the dedicated power supply 37 also comprises at least one control switch 39 driven by the acquisition means 30 so as to cut the power supply of the controller-inverter 38 during the measurements. The dedicated power supply 37 then comprises capacitors 40 that then deliver the electrical energy necessary for the measurement.

It should be pointed out that, in FIG. 3, only the dedicated measurement chain 34 and its dedicated power supply 37, associated with the pH sensor 18*b*, are represented, it being understood that the unit 20 also comprises a same dedicated measurement chain and its associated dedicated power supply for each of the other sensors of chemical parameters and, here, for the chlorine content sensor 18*c*. Alternatively, the electronic layout may be optimized so as to use the maximum number of shared electronic components for the measurement chains of the various sensors.

According to the example illustrated, the acquisition unit 20 also comprises communication means 45 formed here by a radio communication module suitable for transmitting the results of the measurements to the unit 5, which is then equipped with a suitable receiver. The use of such a radio transmitter 45 also contributes to a perfect electrical insulation of the sensors and of the acquisition unit 20 with respect to the water that is the subject of the measurements.

In order to guarantee a sufficient service life of the self-contained power source 32, the processing means 30 are adapted for providing an intermittent power supply for the measurement means 18*a*, 18*b*, 18*c*, 34, 37 and the transmission means 45, so as not to transmit the measurements made continuously but periodically according to a period, for example, of the order of five minutes. Thus, between two sequences of acquisition and of transmission of the measurements, the acquisition unit will be placed in an unenergized state. In this unenergized state, the radio transmission means and the sensors of physical parameters and their associated measurement chains are not supplied with power. On the other hand, in order to ensure the quality of the measurement of chemical parameters, at the moment of the actual acquisition, it is advisable to maintain a certain stability over time of the power supply of the chemical measurement sensors. For this purpose, a choppy power supply of the chemical measurement sensors and also of their associated measurement chains will be able to be envisaged during the period referred to as the unenergized period. This choppiness could for example involve a charging of a few milliseconds, for example 10 ms, at intervals of a few seconds, for example 20 s.

According to the example illustrated, the acquisition unit also comprises means 46 for connecting a sensor, such as for example a pressure sensor 47 located on the filter 4" at a distance from the device 10.

The device 10 according to the invention thus constituted makes it possible to greatly simplify the installation of all of the sensors necessary for a quasi-automatic maintenance of the water quality of the swimming pool P.

Furthermore, it should be noted that although, according to the example described previously, the acquisition unit 20 is directly integrated into the casing 21, it could also be envisaged to provide it in a self-contained manner in order to be used either with a device similar to the device according to the invention or else in order to be integrated into another type of plant for monitoring and maintaining the water quality of a leisure pool.

According to the example illustrated, the device is inserted into the existing water circulation circuit, the measurement channel being an integral part of this circuit. It may also be envisaged for the device to be assembled as a branch conduit with respect to the existing circuit.

Of course, various other modifications may be made to the invention within the scope of the claims.

The invention claimed is:

1. A device (10) for measuring physical and/or chemical parameters of water circulating in a treatment circuit (8) of a leisure pool (P), which comprises:

a. a main body (12) through which a measurement channel (13) passes;

b. means (14*a*, 14*b*) for connecting the measurement channel (13) to the treatment circuit (8);

c. at least two measurement sensors (18*a*, 18*b*) fitted to the main body in order to be in contact with the inside of the measurement channel (13), including at least one sensor for a chemical parameter of the water chosen from: the pH, the dissolved chlorine content and the dissolved oxygen content;

d. an acquisition unit (20) connected to the measurement sensors and comprising a self-contained electric power source (32) and wireless communication means (45) for communicating with a central unit (5);

e. a measurement chain (34) dedicated to the chemical sensor; and f. a dedicated power supply (37) for the dedicated measurement chain (34) comprising a controller-inverter (38).

2. The device as claimed in claim 1, wherein the acquisition unit comprises means (30) for processing the measurements made by the sensors and wherein the wireless communication means (45) are adapted to at least transmit one or both of the measurements made by the sensors and the result of the processing of these measurements by the processing means.

3. The device as claimed in claim 1, wherein the acquisition unit (20) is positioned inside the receiving casing (21) attached to the main body.

4. The device as claimed in claim 1, wherein the self-contained electric power source (32) comprises at least one electric accumulator (33).

5. The device as claimed in claim 1, wherein the acquisition unit (20) is adapted in order to provide an intermittent power supply for the sensors (18*a*, 18*b*) and the communication means (45).

6. The device as claimed in claim 1, wherein the acquisition unit (20) is adapted in order to periodically acquire the measurements from each sensor according to a period having a duration between 3 min and 10 min.

7. The device as claimed in claim 1, wherein the dedicated power supply (37) comprises at least one capacitor (40) charged by the controller-inverter (38) and wherein the acquisition unit is adapted in order, during the acquisition of a measurement from the chemical sensor, to cut the power supply of the controller-inverter (38) so that the dedicated measurement chain (34) is only powered by the capacitor.

8. The device as claimed in claim 1, wherein the acquisition unit comprises means (46) for connecting an external measurement sensor (47).

9. The device as claimed in claim 1, which comprises a temperature sensor (18*a*), a pH sensor (18*b*), and a sensor (18*c*) of the amount of chlorine or oxygen dissolved in the water, which are fitted to the main body (12), and a pressure sensor (47), which is located at a distance from the main body (12) and is connected to the acquisition unit (20).

10. The device as claimed in claim 1, wherein the main body (12) comprises means (17*a*, 17*b*) for installing and holding the sensors, comprising, for each sensor, a shaft that extends transversely to the axis of the measurement channel and that opens into the latter.

* * * * *